United States Patent [19]

Phelan

[11] 4,399,483

[45] Aug. 16, 1983

[54] SOLENOID CURRENT CONTROL

[75] Inventor: Brian D. Phelan, New Britain, Conn.

[73] Assignee: Chandler Evans, Inc., West Hartford, Conn.

[21] Appl. No.: 346,489

[22] Filed: Feb. 8, 1982

[51] Int. Cl.[3] ..... H01H 47/32

[52] U.S. Cl. ..... 361/154; 361/152

[58] Field of Search ..... 361/152, 154

[56] References Cited

U.S. PATENT DOCUMENTS 4,293,888 10/1981 McCarty ..... 361/154 X

FOREIGN PATENT DOCUMENTS 906726 3/1954 Fed. Rep. of Germany ..... 361/154

*Primary Examiner*—Reinhard J. Eisenzopf

[57] ABSTRACT

The response time and power consumption of a solenoid-type actuator are minimized through exercising control over a transistor connected in series with the solenoid coil and a current source. Upon receipt of a command signal the series connected transistor is driven into saturation for a period of time commensurate with the current flow through the coil to rise to the level where a magnetic field of sufficient magnitude to pull in the solenoid plunger will be generated. The solenoid current is, once the solenoid armature moves, reduced to that level needed to maintain the field by controlling the transistor such that there is a constant voltage across the solenoid winding.

11 Claims, 2 Drawing Figures

SOLENOID CURRENT CONTROL

BACKGROUND OF THE INVENTION (1) Field of the Invention

The present invention relates to electro-mechanical actuators and particularly to control systems which employ solenoids to impart movement to a controllable member. More specifically, this invention is directed to the exercise of control over a solenoid to enhance response time while minimizing power requirements. Accordingly, the general objects of the present invention are to provide novel and improved apparatus and methods of such character.

(2) Description of the Prior Art

While not limited thereto in its utility, the present invention is particularly well suited for use in time modulated controls of the type shown in U.S. Pat. No. 3,430,536. In such controls, in response to command and feedback signals and the output of a carrier frequency oscillator, a solenoid actuated control valve is operated in a pulse width modulated mode to deliver gas from a supply to a pneumatic actuator which, for example, positions a steering fin of a missile. Considering the missile control environment, it is necessary that the actuator respond quickly to command signals. However, because of space and weight limitations, the power consumption of the control must be minimized. These constraints on weight and space are particularly demanding in the case of batteries which supply power to the solenoid actuators of the control system. The requirements of fast response and low power consumption area, to a large extent, conflicting. Thus, attempts to minimize response time by reducing solenoid impedance are met by increased power consumption. Thus, the design of most prior art control systems employing solenoid actuators, particularly those systems intended for the demanding environment of a missile, has involved a compromise between fast response and low power consumption.

SUMMARY OF THE INVENTION

The present invention overcomes the above-discussed and other deficiencies and disadvantages of the prior art by providing a novel technique for the exercise of control over the current supplied to a solenoid and circuitry intended for use in the practice of this technique.

In accordance with the present invention, upon receipt of a command signal, a transistor connected in series with the winding of a solenoid is driven into saturation whereby the current flow through the solenoid will rapidly increase to the level commensurate with the generation of a sufficiently strong field to cause the solenoid armature to move. The time during which the series connected transistor is held in the saturated condition is predetermined and when this period has expired the solenoid current will be reduced to a level commensurate with the generation of field of sufficient strength to "hold in" the plunger by applying a control voltage of reduced magnitude to the base of the series connected transistor. The control voltage for the series connected transistor is derived by sensing the voltage across the solenoid winding and feeding back a control signal which will result in this voltage being maintained constant and the solenoid current decaying exponentially to a predetermined steady-state level.

Apparatus in accordance with a preferred embodiment of the present invention comprises a controlable switching transistor connected in series with the solenoid winding. The preferred embodiment also comprises an input transistor which, in response to receipt of a command pulse, will provide a trigger signal to a timer which may comprise a one-shot multivibrator. The output of the multivibrator, which has a preselected period, will be applied to the base of the switching transistor and will be of sufficient magnitude to cause this transistor to go into saturation whereby the current flow through the series connected solenoid will rapidly increase to a maximum level commensurate with the generation of a solenoid pull-in field. The voltage across the solenoid winding is sensed and a control signal commensurate with this voltage fed back via the input transistor to the base of the switching transistor. Accordingly, when the multivibrator resets, the switching transistor will be controlled by the voltage feed back signal and the solenoid current will decay exponentially to a preselected steady-state level.

BRIEF DESCRIPTION OF THE DRAWING

The present invention may be better understood and its numerous objects and advantages will become apparent to those skilled in the art by reference to the accompanying drawing wherein.

DESCRIPTION OF THE PREFERRED EMBODIMENT

Figure 1:
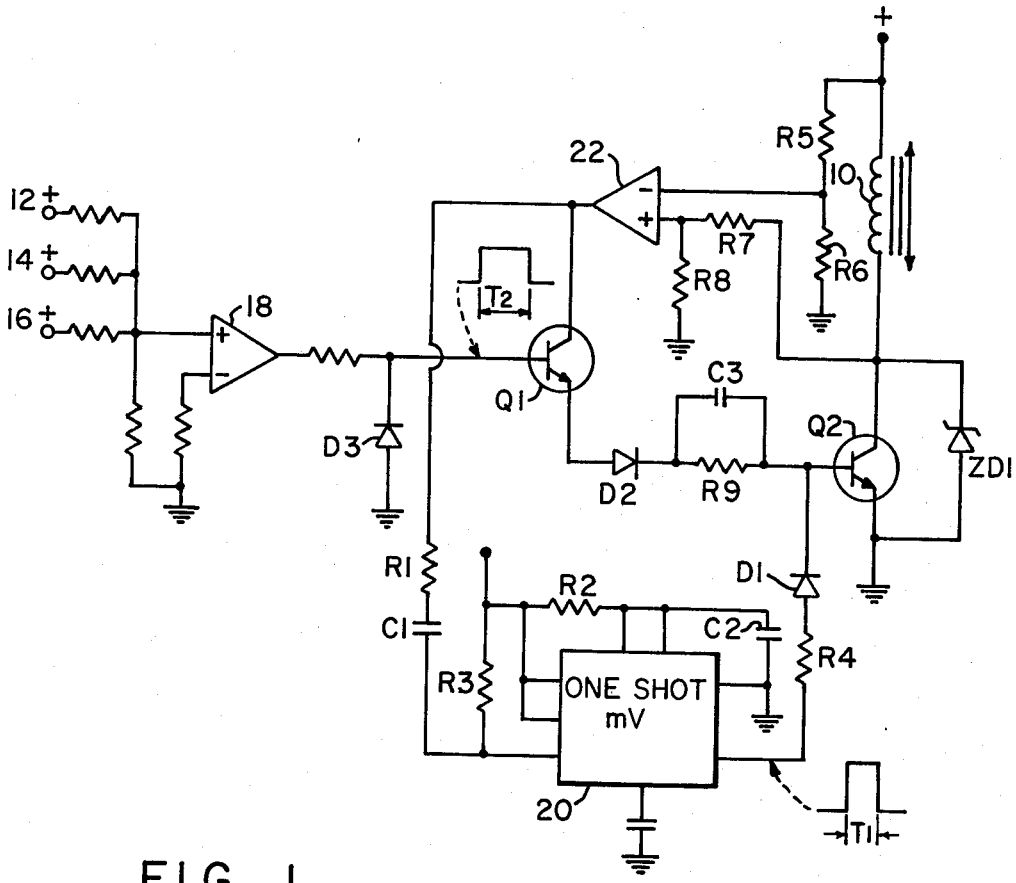
FIG. 1 is a schematic circuit diagram of a preferred embodiment of the present invention.

With reference to the drawing, the coil of a solenoid actuator is indicated at 10. The solenoid will, of course, include a movable plunger or armature which is mechanically coupled to the device, a valve member for example, to be controlled. The solenoid winding 10 is connected in series with a current source, not shown, and a switching transistor Q2. In the disclosed embodiment a first end of winding 10 is connected to the positive polarity terminal of the current source and the negative polarity terminal of the source is at ground potential A solenoid, like ferromagnetic circuits, is characterized by hysteresis. Accordingly, while a large amount of current is needed to generate a magnetic field of sufficient magnitude to impart movement to the solenoid armature, a comparatively small amount of current is required to maintain that field. Thus, in accordance with the present invention, once the armature moves the solenoid current is reduced thereby resulting in a significant reduction in power consumption.

Considering the present invention in the environment of a pulse width modulated control system, input signals commensurate with a command, a position feedback and the output of a carrier frequency signal generator, the carrier typically having a triangular wave form, are respectively applied to input terminals 12, 14 and 16. The input signals are all delivered to and summed in an operational amplifier 18 which provides, at its output, a pulse width modulated command signal having a square wave form and a variable duration. This pulse width modulated command signal is applied to the base of an input transistor Q1. The command signal will cause transistor Q1 to become conductive whereupon the collector voltage of this transistor will decrease. This drop in Q1 collector voltage, via a pulse shaping a circuit comprising resistor R1 and capacitor C1, will be applied as a negative trigger pulse to a monostable multivibrator 20.

The output of multivibrator 20, which overrides the current limiting circuitry to be described below, is applied to the base of the switching transistor Q2 and drives this transistor into saturation. The period of the output pulse of multivibrator 20 will be predetermined and will be set by selecting the value of capacitor C2 and resistor R2. In one application, the fastest response time of the solenoid was 1.4 msec. Accordingly, the period of the output signal of multivibrator 20 would, for this application, be 1.4 msec or slightly greater. Resistor R4, which is in series with the output of multivibrator 20, serves merely for current limiting while diode D1 protects the multivibrator from signals appearing at the base of transistor Q2 by reason of the operation of the current limiting circuit.

When multivibrator 20 resets, transistor Q2 will come out of saturation and be operated in a linear mode. The operation of transistor Q2 in a linear mode will result in the solenoid current falling to a level which is determined in the manner to be described below.

In accordance with the present invention, the voltage across the solenoid winding 10 is sensed by an operational amplifier 22 and a signal commensurate with the sensed voltage is fed back via input transistor Q1 to control the base drive to transistor Q2. A resistor network at the input to amplifier 22, comprising a first voltage divider defined by resistors R5 and R6 and a second voltage divider defined by resistors R7 and R8, will determine the minimum current level which will be sustained during the period that transistor Q1 is in the conductive state by virtue of the application of a command signal to the base thereof. The values of resistors R5–R8 are determined by first calculating the hold-in current of the solenoid under the operating conditions to be experienced. Resistors R7 and R8, which are connected to the non-inverting input of amplifier 22, are selected such that, taking into account the reference voltage applied to the inverting input of amplifier 22, the amplifier output will produce the requisite minimum current. Resistors R5 and R6 are selected taking into account the magnitude of the source voltage so as to set a reference voltage within the working voltage range of the operational amplifier. Under these conditions, with the voltage dividers being connected to the opposite ends of the solenoid winding 10 as shown, the output of amplifier 22 will vary as a function of the solenoid voltage. In one reduction to practice, the output of amplifier 22 was +15 v prior to receipt of an input pulse. The amplifier output, and thus the collector voltage of Q1, switched to −15 v upon receipt of an input pulse. At time T1, when the one-shot 20 reset, the amplifier output voltage switched to a positive potential which varied as a function of the voltage drop across coil 10, this control voltage being in the range of +1 v to +2 v. The control voltage in the range of +1 to +2 voltage applied to the collector of Q1 with a command pulse on the base of Q1 will result in Q2 being controlled in a linear manner so as to maintain a constant voltage drop across coil 10. During the period of the pulse provided by timer 20, transistor Q1 will be reverse biased by the high negative voltage applied to its collector.

To restate the above, the output of amplifier 22 is connected in a common collector mode with the input transistor Q1 which has its base driven by the pulse width modulated command signal provided by amplifier 18. The emitter of transistor Q1 is connected, via a filter circuit comprising capacitor C3 and resistor R9, to the base of the switching transistor Q2. Accordingly, the pulse width modulator amplifier 18 functions as a switch control while the voltage feedback amplifier 22 functions as a precision current control such that the collector voltage of the switching transistor Q2 will remain constant.

The high frequency filter circuit defined by capacitor C3 and resistor R9 prevents the dissipation of power through high frequency oscillation in the circuit.

In the operation of the above-described circuit, a linear relationship between solenoid voltage and current is not established. Rather, the solenoid voltage will be the controlling factor and, upon resetting of multivibrator 20, the solenoid current will decay exponentially until the steady-state minimum current level is reached.

Figure 2:
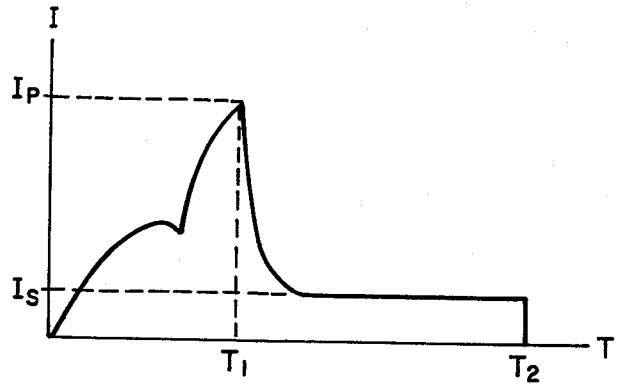
FIG. 2 is a wave form diagram which depicts the current flow through the solenoid of the circuit of FIG. 1.

The current wave form produced by the circuit shown in FIG. 1 is depicted in FIG. 2. From FIG. 2 it may be seen that, during the period when one-shot multivibrator 20 is in the set state, the solenoid current will rapidly increase to the maximum value $I_p$. The knee or break in the curve corresponds to the field strength at which the solenoid armature begins to move, movement of the armature changing the inductance and thus the impedance of the winding. When the multivibrator resets, at time $T^1$, the current will fall exponentially to the sustaining current level $I_s$ where it will remain, under control of the feedback circuit comprising amplifier 22, until the command signal is removed from the base of transistor Q1 at time $T_2$.

The Zener diode ZD1 connected in parallel with transistor Q2 provides over-voltage protection for the semiconductor. Similarly, the diode D2 in series with the emitter of transistor Q1 protects this transistor from reverse bias current. The diode D3 connected between the base of transistor Q1 and ground protects Q1 from reverse voltage from amplifier 18.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A current control for a solenoid actuator, the actuator including a coil and a movable armature associated therewith, said control comprising:

normally non-conductive controllable solid state switch means, said switch means being connected in series with the actuator coil and a current source;

means responsive to the voltage across the actuator coil for generating a control signal;

means responsive to input command signals and to said control signals for generating trigger pulses;

timer means responsive to said trigger pulses for generating switch control pulses of a first polarity and a preselected duration, said switch control pulses being of sufficient magnitude to cause said switch means to change from the non-conductive state to a saturated state, the duration of said switch control pulses being commensurate with the time required for the current through the actuator coil to increase to a level which will generate a sufficiently strong field to impart motion to the actuator armature;

means for applying said switch control pulses to said switch means; and means for applying control signals of the said first polarity generated by said means responsive to the voltage across the actuator coil to said switch means when an input command signal is present.

2. The apparatus of claim 1 wherein said means for generating trigger pulses comprises:

an input transistor, input command signals being applied to the base of said input transistor, control signals generated by said means responsive to the actuator coil voltage being applied to the collector of said input transistor, the emitter of said input transistor being connected to said means for applying control signals to said switch means, a control signal of said first polarity appearing at said input transistor means collector when an input command signal is present and a timer means switch control pulse has been removed from said switch means, the removal of a timer means generated switch control pulse and the application of said control signal to said switch means causing said switch means to regulate the current flow through the solenoid as a function of the voltage across the solenoid coil.

3. The apparatus of claim 2 wherein the input command signals are pulse width modulated and the duration of said timer means generated switch control pulses is less than the shortest expected command signal pulse.

4. The apparatus of claim 3 wherein said input transistor is reverse biased upon the application of an input command signal pulse thereto and will be forward biased by said control signals upon termination of a timer means generated switch control pulse.

5. The apparatus of claim 4 wherein said control signal generating means provides control signals of variable polarity at said input transistor collector.

6. The apparatus of claim 5 wherein said control signal generating means comprises:

an operational amplifier;

means applying a voltage proportional to the potential at a first end of the solenoid coil to the inverting input of said operational amplifier; and means applying a voltage proportional to the potential at the second end of the solenoid coil to the non-inverting input of said operational amplifier.

7. The apparatus of claim 6 wherein said switch means comprises a transistor, said transistor being operated in a saturated mode in response to said switch control pulses and in a linear mode in response to said control signals.

8. The apparatus of claim 2 wherein said input transistor is reverse biased upon the application of an input command signal pulse thereto and will be forward biased by said control signals upon termination of a timer means generated switch control pulse.

9. The apparatus of claim 8 wherein said means responsive to the voltage across the actuator coil for generating control signals comprises:

means for sensing the solenoid coil voltage drop and for generating a control signal of variable polarity, said variable polarity signal being commensurate in magnitude with voltage across the coil when said switch means transistor is conductive and non-saturated.

10. The apparatus of claim 9 wherein said switch means comprises a transistor, said transistor being operated in a saturated mode in response to said switch control pulses and in a linear mode in response to said control signals.

11. The apparatus of claim 1 wherein said means responsive to the voltage across the actuator coil for generating control signals comprises:

means for sensing the solenoid coil voltage drop and for generating a control signal of variable polarity, said variable polarity signal being commensurate in magnitude with voltage across the coil when said switch means transistor is conductive and non-saturated.

* * * * *